United States Patent [19]

Osmond et al.

[11] 3,998,605

[45] * Dec. 21, 1976

[54] POLYMER SOLUTION

[75] Inventors: Desmond Wilfrid John Osmond, Windsor; Norman Douglas Patrick Smith; Frederick Andrew Waite, both of Farnham Common, all of England

[73] Assignee: Imperial Chemical Industries Limited, London, England

[ * ] Notice: The portion of the term of this patent subsequent to Dec. 7, 1993, has been disclaimed.

[22] Filed: July 9, 1973

[21] Appl. No.: 377,193

Related U.S. Application Data

[63] Continuation of Ser. No. 79,702, Oct. 9, 1970, abandoned.

[30] Foreign Application Priority Data

Oct. 10, 1969 United Kingdom ..... 49835/69

[52] U.S. Cl. ..... 44/62; 44/80

[51] Int. Cl.[2] ..... C10L 1/16

[58] Field of Search ..... 44/62, 80, 7 C, 7 D, 44/7 E

[56] References Cited

UNITED STATES PATENTS

| | | | |
|---|---|---|---|
| 3,326,804 | 6/1967 | Roselle | 44/62 |
| 3,443,917 | 5/1969 | Le Seur | 44/80 |
| 3,524,732 | 8/1970 | Sweeney et al. | 44/80 |
| 3,598,552 | 8/1971 | Cohen et al. | 44/80 |

*Primary Examiner*—Y. Harris-Smith
*Assistant Examiner*—Y. Harris Smith
*Attorney, Agent, or Firm*—Cushman, Darby & Cushman

[57] ABSTRACT

The dissemination of gas turbine aviation fuels under shock conditions, particularly and the accompanying fire hazard are reduced by dissolving in the fuel a segmented copolymer of ethylene and a higher olefine. The fuel may be gelled by the dissolved copolymer or if the molecular weight is greater than $10^6$ and the concentration of the polymer is such that its molecules overlap in the fuel, the fuel may be a liquid, but with a reduced tendency to form mist particles under shock conditions.

4 Claims, No Drawings

POLYMER SOLUTION

This is a continuation of application Ser. No. 79,702, filed Oct. 9, 1970, now abandoned.

This invention relates to improved liquid hydrocarbon aircraft fuels.

Vapours of low flash point liquid hydrocarbon aircraft fuels, being readily ignited, are a major hazard under crash conditions. This hazard can be reduced to some extent by gelling the fuel to reduce spread of fuel spilled from tanks ruptured in a crash. Safety can also be improved by using liquid hydrocarbon fuels of flash point not less than 90° F. but even then, mists of such fuels can form when the liquid is subjected to conditions of shock and these may be as readily ignitable as vapour from low flash point fuel.

We have now found that the fire hazard under crash conditions can be reduced by dissolving in the fuel a copolymer of ethylene with a higher olefine, preferably propylene, which contains not more than 95%, preferably not more than 85%, by weight of ethylene and has a molecular structure comprising at least 2 and preferably at least 10 runs of at least 10 and preferably at least 20 units of ethylene separated by runs of hydrocarbon-soluble polymer which may be a random copolymer of ethylene and higher olefine or a homopolymer of the higher olefine.

At ambient temperatures, homopolymer of ethylene is insoluble in liquid hydrocarbons of the type used in aircraft fuel due to its crystallinity. This crystallinity can be destroyed, and hence the solubility of the polymer in liquid hydrocarbons can be improved, by copolymerising another olefine with ethylene and so breaking up the regularity of the polyethylene chains. We have found that when copolymers have the selected molecular structure described above then although the copolymer as a whole is soluble in hydrocarbon liquid, the runs of ethylene units in the polymer chain still tend to associate and crystallise in the solution, so providing inter-molecular bonds.

This tendency can be used to provide a crosslinked structure in the fuel such that the liquid fuel is converted to a gel. For this purpose a proportion of copolymer in the weight range 0.1 – 10% by weight of the fuel may be used, the proportion depending on the molecular weight of the copolymer and the proportion and distribution of ethylene therein. The molecular weight of the soluble copolymer must be at least 10,000 (viscosity average) and preferably at least 100,000. When used at the lower concentration the copolymer should be of higher molecular weight which may be $10^6$ or more. However, copolymers of molecular weights of more than $10^6$ used at concentrations of more than 5% by weight of the liquid may produce a gel structure too strong for the fuel to be transferred within conventional fuel systems of aircraft. With higher proportions of ethylene, say 70 – 90% by weight, lower weight proportions of copolymer are required to gel the fuel than with lower proportions of ethylene, say 40 – 70% by weight.

The gel strength to be developed in the fuel can be varied according to the particular requirements and circumstances of use. From the point of view of reducing spread of any spilled fuel, high gel strengths are desirable but there is usually a limit to gel strength which is set by the need to be able to transfer the fuel from tank to tank and from tank to engine. The concentration and type of copolymer required to produce a fuel which will not spread on spillage may be determined by a simple arbitrary test in which an open-ended, internally-smooth cylinder 20 cm. in diameter and 20 cm. in height is stood on a flat plate, the lower open end of the cylinder forming a seal with the plate. The cylinder is then filled with the gelled liquid under test. After allowing the liquid to stand for sufficient time for the gel structure to reform, the cylinder is lifted vertically to leave the mass of gelled liquid standing unsupported on the plate. This unsupported mass will sag and spread out over the plate. If the mass spreads to such an extent that the resulting layer is only a millimeter or less in average thickness then the gel strength is insufficient. If the mass retains a maximum height of at least 10 cms. this is an indication that specially designed fuel systems, e.g. flexible tanks under external pressure, will be needed to handle it as aircraft fuel. If the gelled liquid spreads to such an extent that the average thickness is in the range 0.5 – 5 cms. this is an indication that it will provide a worthwhile improvement in safety and yet can be accommodated in standard or modified fuel systems.

Liquid hydrocarbon fuels which may be gelled include Aviation Turbine Fuels Grade JP-8 (flash point 110° F. min.) as specified in U.S. Military Specification MIL-T-83133, Grade JP-5 (flash point 140° F. min.) as specified in U.S. Military Specification MIL-T-5624G, Grades Jet A and Jet A-1 (flash point 110° F. min.) as specified in ASTM Specification D.1655/66T, Grade AVTUR - NATO Code No. F-35 (flash point 100° F. min.) as specified in U.K. Ministry of Aviation Specification No. De Eng. specified in U.S. Military Specification MIL-T-5624G, Grade Jet-B as specified in ASTM Specification D.1655/66T and Aviation Turbine Fuel Avtag — NATO Code F-45 as specified in U.K. Ministry of Aviation Specification No. D. Eng. R. D. 2486 (Issue 5).

In a preferred embodiment of the invention selected copolymers as described above may also be used to produce safer fuels even though the fuels may not have a gel structure which will usefully prevent spread on spillage, i.e. if it is a free-flowing liquid which in the above-described test spreads out in a layer of one millimeter or less in average thickness. This embodiment of the invention is a development of the invention of our earlier application Ser. No. 818,249 in which we have described how the tendency of liquid hydrocarbon aircraft fuels to form mists when subjected to shock conditions can be reduced by dissolving in the fuel a polymer of molecular weight greater than $10^6$ (viscosity average) or of intrinsic viscosity greater than 2.5 dls./gm. in a concentration such that there is molecular overlap of the dissolved polymer. The term "molecular overlap" describes the condition in which the segment density of the dissolved polymer in the liquid is substantially uniform on a molecular scale and this condition corresponds to concentrations at and above that at which the centres of mass of the polymer molecules are spaced, on average, at twice the radius of gyration of the polymer molecules.

We have now found that when hydrocarbon-soluble ethylene/propylene copolymers of these selected molecular weights or intrinsic viscosities are dissolved in fuel in a concentration required for molecular overlap, the mist-forming tendency of the fuel is further reduced when the copolymer has the above-mentioned selected molecular structure.

This embodiment of the invention is particularly useful when applied to fuels of flash point not less than 90° F. and in which the fire hazard arises not so much from ignition of vapour as ignition of mists of the fuel.

In this embodiment of the invention the modified fuels may be free-flowing liquids at ambient and operating temperatures, even when the temperature which they are likely to reach in use is as low as −50° C., but even though the fuels may be free-flowing liquids at low rates of shear, their tendency to form mists when subjected to shock is reduced. It is believed that this is due to development of a crosslinked structure, arising from associative bonds formed between the runs of ethylene units, when the fuel is subjected to shock conditions.

In this embodiment suitable concentrations of dissolved copolymer are in the range 0.01% – 1% by weight of the liquid fuel.

The basic requirement is that the concentration of copolymer is at least that required for molecular overlap and this may be determined by a test in which the viscosity of a range of solutions of copolymer in the fuel is measured on a cone and plate or concentric cylinder viscometer (e.g. a Weisenberg rheogoniometer or a Contraves Rheomat) at shear rates covering the range 20 – 20,000 sec.$^{-1}$. In respect of each solution the viscosity is plotted against the shear rate and the curve arbitrarily extrapolated at zero shear rate. The zero shear rate viscosities are then plotted against concentration on log/log scales. The log/log scales when plotted for closely spaced concentrations show an upturn at which abnormal viscosity begins to occur. Suitable copolymer concentrations to use in the modified fuels are from 1 – 10 times the proportion at which this upturn occurs and preferably from 1.5 – 5 times the proportion at which this upturn occurs. Preferably, in the embodiment of this invention in which the fuel is a free-flowing liquid, the viscosity of the modified fuel is less than 10 poises at zero shear rate at ambient temperature and more preferably is less than 1 poise.

The resistance of a solution to shock formation of droplets may also be determined by a simple test in which a 10 ml. sample of the modified fuel is dropped in a thin stream from a height of 2 meters into a hollow cylindrical vessel of diameter 17 cm. and height 21 cm. having its sides lined with absorbent paper. In order to facilitate observation a small quantity of soluble dye is added to the sample of fuel. The density and size of the spots produced on the paper by droplets splashed from the sample gives an indication of its misting characteristics. The minimum copolymer concentration at which there are substantially no spots on the absorbent paper is the minimum useful concentration and in aircraft fuels the copolymer concentration should be in the range 1 – 10 times this minimum concentration, preferably from 1.5 – 5 times this concentration.

Where the fuel is to be a free-flowing liquid at low shear rates at operating temperatures a useful guide to suitable concentrations of copolymer to use is given by an arbitrary test in which solutions of various concentrations of the copolymer in aircraft fuel are warmed to about 60° – 80° C. to thoroughly dissolve the copolymer, and then cooled to the highest operating temperature. A suitable concentration of copolymer to use is about 5 – 20% of the lowest concentration which forms a gel at that temperature. The highest operating temperature is different, of course, in different parts of the world, and the value for an arbitrary test may be set at 25° C.

Ethylene/higher olefine copolymers suitable for use in this invention may be made by the low temperature processes described in our Downing patent application Ser. No. 79,703 filed October 9, 1970, now abandoned.

The copolymers to be used in this invention do not fully dissolve to give a clear solution when simply added to liquid hydrocarbon fuels at room temperature; at room temperature the solutions obtained are cloudy. In a further development of the present invention improved aircraft fuels are made by heating a liquid hydrocarbon fuel with up to 10% by weight of the selected ethylene/higher olefine copolymer to fully dissolve the copolymer and thereafter cooling the solution and optionally diluting it with additional hydrocarbon liquid. This process may be used to prepare relatively concentrated solutions which are then diluted with from 5 – 1000 times their weight of unmodified fuel to form a modified fuel suitable for use in aircraft.

The invention is illustrated by the following Examples.

EXAMPLE 1

A liter of n-heptane, distilled over calcium hydride, is presaturated for 20 minutes with high purity ethylene and propylene by metering these gases into the vigorously stirred solvent, contained in a 2 liter glass reaction vessel, at 67 and 327 liters/hr. respectively. During this time the vessel and contents are cooled to −45° C. by immersion in an acetone/solid $CO_2$ bath. After presaturation 2.0 mls. of a 2.5 M solution of aluminum diethyl chloride in n-heptane is injected into the solution followed 2 minutes later by 0.10 mls. of a 0.5 M solution of vanadium tetrachloride in n-heptane. After 15 – 20 minutes an insoluble mass of polymer starts to form. The polymerisation is allowed to run for 1 hour and then the catalyst is destroyed by the injection of 10 ml. methanol. The reacted mixture is poured into 4 liters of methanol and the solid polymer is separated and vacuum dried at 30° – 40° C.; yield 123 g. I.R. analysis gives 21% (molar) propylene content. The intrinsic viscosity of the copolymer in Avtur aircraft fuel at 25° C. is 13.7 dl./g. When the copolymer is dissolved in Avtur, mist formation of the fuel is suppressed at copolymer concentrations as low as 0.015% by weight.

The same process is used for Examples 2, 3, 4 and 5 with modification of the variables as shown in the Table.

| Example: | 1 | 2 | 3 | 4 | 5 |
|---|---|---|---|---|---|
| Solvent | 1 liter n-heptane distilled over $CaH_2$ | 1 liter EC 180 distilled over $CaH_2$ | 1 liter cyclo-hexane distilled over $CaH_2$ | 1 liter Avtur distilled over conc. $H_2SO_4$ | 2 liters n-heptane distilled over $CaH_2$ |
| Polymerisation temperature | −45° C ± 1.5° | same | same | same | −47.5° C. ± 0.5° |
| Presaturation feed rates | | | | | |

-continued

| Example: | 1 | 2 | 3 | 4 | 5 |
|---|---|---|---|---|---|
| (liters/hour) | | | | | |
| propylene | 327 | 328 | 327 | 470 | 856 |
| ethylene | 67 | 48 | 48 | 40 | 210 |
| P/E ratio | 4.9 | 6.8 | 6.8 | 11.8 | 4.1 |
| Presaturation time (mins.) | 20 | 22 | 17 | 17 | 17 |
| Polymerisation feed rates (liters/hour) | | | | | |
| propylene | 327 | 327 | 327 | 470 | 850 |
| ethylene | 67 | 67 | 67 | 40 | 210 |
| P/E ratios | 4.9 | 4.9 | 4.9 | 11.8 | 4.1 |
| Polymerisation time (mins.) | 60 | 76 | 24 | 47 | 60 |
| $Et_2AlCl$ (m.moles.$l^{-1}$) | 5.0 | 5.0 | 5.5 | 5.5 | 7.8 |
| $VCl_4$(m.moles.$l^{-1}$) | 0.05 | 0.05 | 0.05 | 0.05 | 0.063 |
| I.R. mole % propylene | 21.0 | 33.8 | 28.2 | 35.0 | 21.0 |
| I.V. Avtur | 13.7 | 10.3 | 10.8 | 10.9 | 12.5 |
| Yield (g.) | 123 | 25 | 66 | 15 | 232 |
| Anti-misting min.conc. (%) | 0.015 | 0.09 | 0.07 | 0.07 | 0.01 |
| Form of polymer during prepn. | Coagulated insoluble mass | same | same | same | Dispersion of particles (5 liter vessel) |

Copolymers (Examples 1, 2, 3 and 4) which are prepared as insoluble coagulated masses are dissolved in aircraft fuels such as Avtur by tumbling the copolymer in the fuel at room temperature for 2 – 3 days to produce solutions, typically, of 1% copolymer concentration. In Example 5 the copolymer is produced as a dispersion of particles. A 1% Avtur solution is easily made by pouring the dispersion, kept at $\leq -48°$ C., into Avtur at room temperature.

When the copolymer is to be dissolved in this way it is preferred to use propane instead of n-heptane in the liquid phase of the polymerisation since the propane is readily removable from the Avtur solution. Alternatively, a solvent of comparable boiling point to Avtur can be used and left in the fuel. These solutions can be diluted by further addition of aircraft fuel. At higher concentrations (>6%) of these copolymers in Avtur a gel can be produced.

Solutions obtained by mixing the copolymers with fuels such as Avtur at room temperature are cloudy and/or bitty. Clear solutions in liquid hydrocarbon fuels can be obtained by heat treatment at 60° C. to 150° C. for 5 minutes, the solutions remaining clear on cooling to room temperature. When the copolymer is dissolved by adding a dispersion of the copolymer to the aircraft fuel, clear solutions can be obtained directly by adding the dispersion to fuel heated to, say, 70° C. or higher. However, the non-heat treated solutions in aircraft fuel still show very good anti-misting properties.

A higher proportion of ethylene in the copolymer usually results in a lowering of the minimum polymer concentration in aircraft fuel at which effective mist suppression is achieved (compare Examples 1 and 2). However, the minimum effective concentration also depends on the distribution of the ethylene and propylene in the copolymer.

What we claim is:

1. A free-flowing liquid hydrocarbon aircraft fuel having a flash point not less than 90° F and containing dissolved therein from 0.01% to 1% by weight of a copolymer of ethylene and propylene which contains not more than 95% by weight of ethylene and has a molecular structure comprising at least 2 runs of at least 10 units of ethylene separated by runs of a hydrocarbon-soluble polymer which may be a random copolymer of ethylene and propylene or a homopolymer of propylene, the dissolved copolymer being soluble in said fuel and of molecular weight at least $10^6$ (viscosity average) or of intrinsic viscosity greater than 2.5 dls./gm. and being present in a concentration such that there is molecular overlap of the dissolved copolymer, the amount of said copolymer being insufficient to increase the viscosity of said liquid to more than 1 poise.

2. A fuel as claimed in claim 1 in which the copolymer contains not more than 85% by weight of ethylene.

3. A fuel as claimed in claim 1 in which the molecular structure of the copolymer comprises at least 10 runs of at least 20 units of ethylene.

4. A fuel as claimed in claim 1 made by heating with a liquid hydrocarbon fuel said copolymer of ethylene and propylene which at room temperature forms a cloudy solution in the fuel, the heating causing the copolymer to fully dissolve, and thereafter cooling the solution.

* * * * *